US005653498A

United States Patent [19]

Grandfield

[11] Patent Number: 5,653,498

[45] Date of Patent: Aug. 5, 1997

[54] HANDS-FREE RECLINING CHAIR

[76] Inventor: Miles Grandfield, 5036 Riverton Ave. #1, No. Hollywood, Calif. 91601

[21] Appl. No.: 631,006

[22] Filed: Apr. 12, 1996

[51] Int. Cl.[6] ..... A47C 1/02

[52] U.S. Cl. ..... 297/85; 297/68

[58] Field of Search ..... 297/68, 83, 84, 297/85, 423.19, 463.1

[56] References Cited

U.S. PATENT DOCUMENTS

| | | | |
|---|---|---|---|
| 3,802,735 | 4/1974 | Re | 297/85 |
| 4,494,793 | 1/1985 | Rogers, Jr. | 297/85 |
| 4,506,926 | 3/1985 | Griggs, Jr. | 297/85 |
| 4,519,647 | 5/1985 | Rogers, Jr. | 297/85 |
| 5,013,084 | 5/1991 | May | 297/85 |
| 5,056,862 | 10/1991 | May et al. | 297/85 |
| 5,137,328 | 8/1992 | Smith et al. | 297/85 |

*Primary Examiner*—Milton Nelson, Jr.

[57] ABSTRACT

A reclining chair including a legrest operated reciprocating latch for releasably retaining the legrest. The legrest linkage is retracted when the occupant applies force to the legrest in a generally rearward direction until the parts of the latch engage one another to retain the legrest in the retracted position. The latch is released by a second, momentary application of force in the same direction, enabling the legrest to move to an extended position.

11 Claims, 2 Drawing Sheets

HANDS-FREE RECLINING CHAIR

BACKGROUND—FIELD OF INVENTION

This invention relates to reclining chairs and more particularly to reclining chairs that have spring or gravity actuated motion assemblies.

BACKGROUND—DESCRIPTION OF PRIOR ART

Reclining chairs have enjoyed great popularity in the furniture industry for decades Manufacturers have continually searched for ways to make them more reliable, easier to operate, better looking, and cheaper to build. Spring and/or gravity actuated reclining chairs are well known in this art. They are normally retained in their upright position by some form of latching device located beneath the seat. When the latch is released, tensioned springs and/or the body weight of the occupant, act on the recliner mechanism to move the chair from an upright to a primary extended position. To return the chair to its upright position, the occupant applies force to the legrest in a generally rearward direction until the latch re-engages to hold the chair in its original state. A number of U.S. Patents have been granted to latch controls for reclining chairs over the years. More recent examples of these are shown in U.S. Pat. Nos. 5,137,328 to Smith (1992), 4,505,926 to Griggs (1985), and 4,494,793 to Rogers (1985).

But these and other known controls for latches used in recliners suffer from several disadvantages including those here listed:

(a) All known latches in recliner chairs have been designed with some form of hand-operated release control. Since the control must be mounted in a location where the occupant can reach it conveniently, and since the latch itself is located beneath the seat, a relatively complicated mechanical linkage between the two becomes necessary. These linkages can be prone to failure over time, are relatively expensive to manufacture and install, and present constraints to the chair's overall design possibilities.

(b) Furthermore, hand-operated latch controls such as levers, push-buttons, and handles normally protrude through the chair's upholstery. This detracts from the chair's appearance, diminishes the integrity of the upholstery material, and immediately identifies the chair as a recliner.

(c) In addition, manually controlled recliners require that the occupant have at least one hand free to operate them. In many situations this can be an inconvenience.

To the best of my knowledge, no known latching device for reclining chairs has been designed to address these deficiencies.

OBJECTS OF THE INVENTION

Accordingly, some of the objects and advantages of the present invention are:

(a) to provide a reclining chair with a latching device that requires no mechanical linkage system to operate it;

(b) to provide a reclining chair with a latching device which is simple and inexpensive to manufacture and install, and which will provide long and reliable service;

(c) to provide a reclining chair with a latching device which is contained under the seat so that it in no way detracts from the appearance of the chair; and (d) to provide a reclining chair that can be moved from an upright position to an extended position by a simple movement of the occupant's legs and thereby leave the occupant's hands free for other purposes.

SUMMARY OF THE INVENTION

A reclining chair constructed in accordance with the present invention is comprised generally of a base, a seat, a backrest, and a legrest which are moveable relative to each other by means of a conventional spring and/or gravity actuated recliner mechanism. A reciprocating latch device is used in lieu of the hand-operated latches heretofore known in such chairs. The legrest linkage is retracted when the occupant applies force to the legrest in a generally rearward direction until the parts of the latch engage one another to retain the leg rest in the retracted position. The latch is released by a second, momentary application of force in the same direction, enabling the legrest to move to an extended position. This latching and unlatching of the mechanism by sequential movement of the legrest in the same generally rearward direction will be hereinafter referred to as reciprocating action. Gravity and/or spring actuated chairs are preloaded during retraction to predispose the linkage to move to the extended position when the latch is released. This preloaded condition provides tension to the latch when it is engaged, enabling it to hold and release as intended in its design.

DRAWING FIGURES

Figure 6:
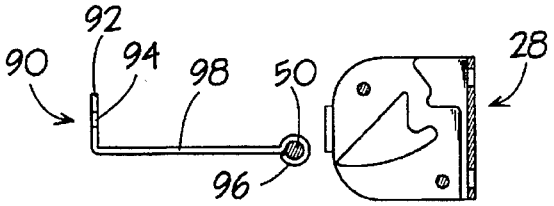
Figure 6A:
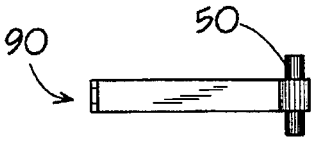

FIGS. 6 & 6*a* show views of a similar latch with a resilient spring arm.

DETAILED DESCRIPTION

Figure 1:
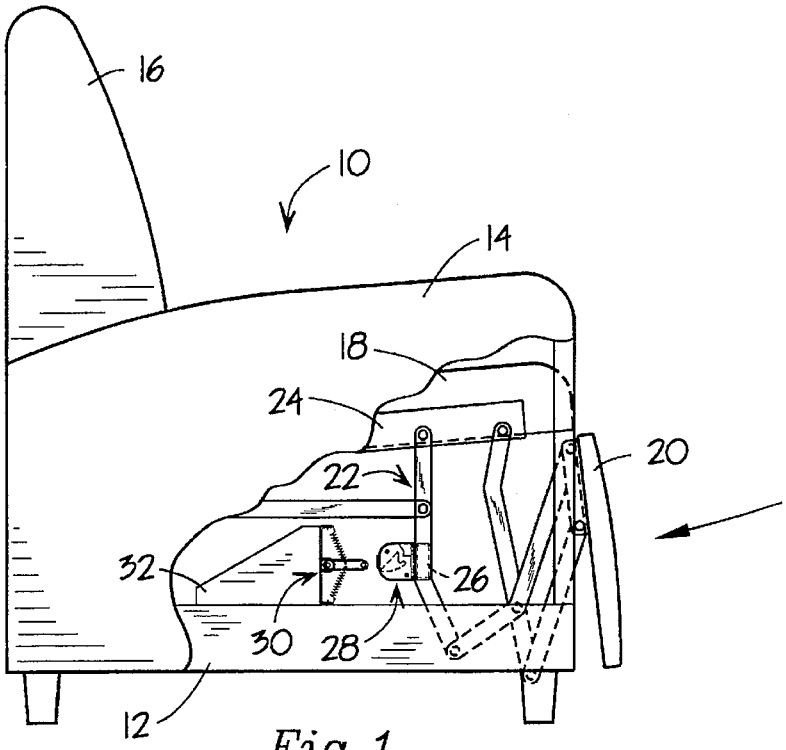
FIG. 1 is a side view of a typical embodiment of the invention with a portion of the upholstery removed to reveal the legrest linkage partially retracted.

Referring initially to the reclining chair depicted in FIG. 1, reference numeral 10 generally identifies an embodiment of a reclining chair commonly known as a two-position spring actuated recliner. The chair 10, comprises a frame 12, with arm rests 14, a backrest 16, a seat 18 and a legrest 20. The legrest 20 is carried by a conventional legrest linkage 22 which is mounted to a seat mounting link 24. The legrest linkage 22 is duplicated on the opposite side of the chair. A tubular cross member 26 connects the two sides of the legrest linkage 22. A reciprocating latch keeper assembly 28 is mounted to the cross member 26 near the middle of the cross member 26. A mounting block 32 is attached to the frame 12 in proximity to the latch keeper assembly 28. A latch arm assembly 30 is mounted to the mounting block 32 so that when the legrest linkage 22 is retracted, the keeper assembly 28 will engage the latch arm assembly 30 to hold the legrest 20 in the retracted position. When the latch is released, tensioned springs (not shown) act on the legrest linkage to move the chair to its extended position in a known way.

Figure 2:
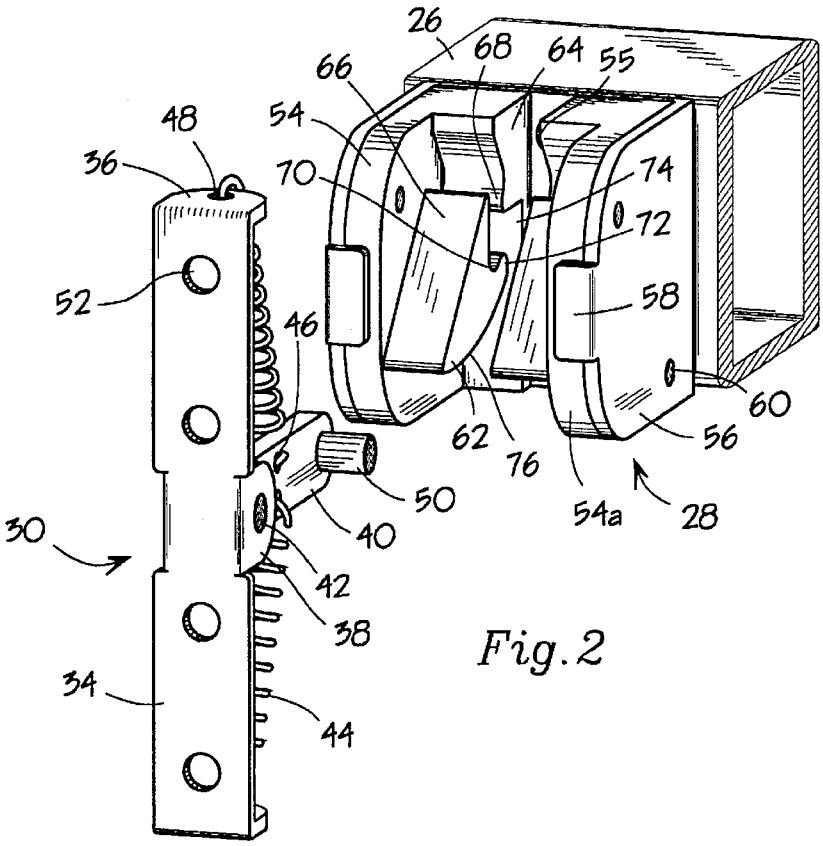
FIG. 2 is a perspective view of a latch constructed according to a preferred embodiment of the present invention.
Figure 3:
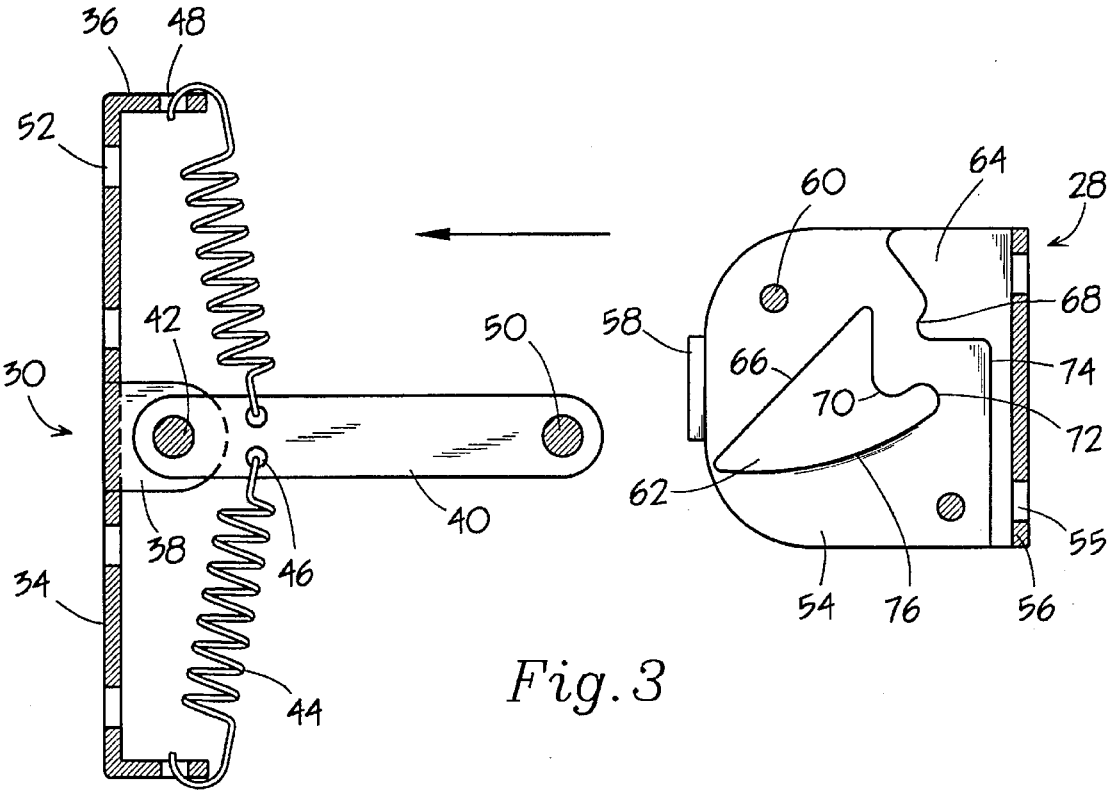
FIG. 3 is a sectional side view of the latch of FIG. 2.

Referring now to FIGS. 2 and 3, an embodiment of the reciprocating latch used in the present invention is shown. The two complimentary parts of the latch generally labeled as the keeper assembly 28 and the latch arm assembly 30 are shown unlatched and in proper alignment. The latch arm assembly 30 includes a bracket 34 with bent over ends 36 and bent over side members 38. A latch arm 40 is pivotally mounted to the bracket 34 by means of a pivot pin 42 for pivotal movement in either direction from a median position generally perpendicular to the bracket 34. A pair of springs 44 are connected to the latch arm 40 at 46 and are suitably mounted at the other end at 48. The springs 44 are preferably of equal strength and thus tend to maintain the latch arm in the median position. A latch pin 50 is mounted on the outer end of the latch arm 40. The bracket 34 is provided with mounting holes 52 suitable for mounting the latch arm assembly 30 to the chair as in FIG. 1.

In FIG. 2 the keeper assembly 28 is shown mounted to a cutaway section of the cross member 26 with rivets 53. The keeper assembly 28 comprises left and right keepers 54–54*a* which are held in a U-shaped bracket 56 by tabs 58 and studs 60. The U-shaped bracket 56 is provided with mounting holes 55 as seen in FIG. 3. The keepers 54–54*a* are machined or moulded of plastic, metal or other material of suitable strength and include a catch member 62 and a stop member 64 of the general shape illustrated. Catch member 62 comprises a ramp 66, a retaining slot 70, a guide finger 72, and a release ramp 76. Stop member 64 has a shoulder 68 disposed at its lower end as shown.

Figure 4:
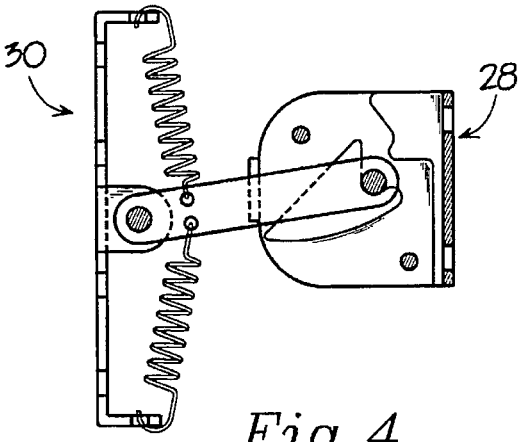
FIG. 4 is a sectional side view of the latch of FIG. 2 showing the relative position of parts with the latch closed.

Keeper assembly 28 is moved toward the latch arm assembly 30 when the occupant of the chair applies rearward force to the legrest 20. As the keeper assembly 28 is advanced, a ramp 66 of the catch member 62 engages the latch pin 50, urging the latch arm 40 to rotate in a counterclockwise direction about the pivot 42. The latch pin 50 rides up the ramp 66 until it clears the ramp 66, at which time the centering springs 44 act to swing the latch arm 40 toward its median position. Its travel is then interrupted by a shoulder 68 of the stop member 64. At this point the person seated in the chair senses that the legrest cannot be retracted further, and so releases pressure on the legrest. This causes the latch pin 50 to move to a retaining slot 70 as shown in FIG. 4 and there the chair is latched in its upright and retracted position. The latch pin 50 is released when the occupant momentarily pushes on the legrest 20 a second time, thus causing the latch pin 50 to ride over a guide finger 72 until its travel is stopped by the back of the stop member 74. When pressure on the legrest is released, the latch arm 40, which still has a bias to move toward its median position, moves below the guide finger 72. The latch pin 50 is now free to travel out of the keeper assembly 28 along the release ramp 76, and thereby allow the legrest linkage to move to its predisposed extended position.

Figure 5:
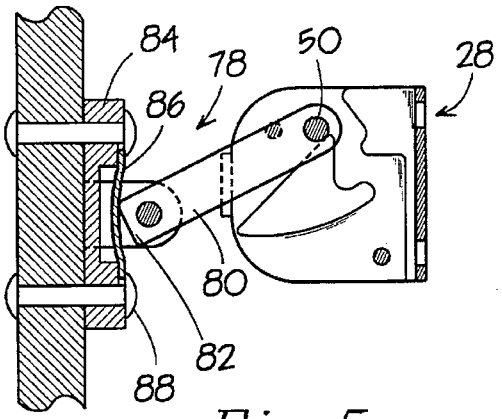
FIG. 5 is a sectional side view of a similar latch with a flat centering spring and showing the latch partially engaged.

In FIG. 5 an alternative embodiment of the latch arm assembly 78 is shown. In this embodiment a latch arm 80 which is flat at its pivotal end 82 is mounted to a bracket 84 fitted with a flat spring 86 which is held in place by rivets 88. The flat spring 86 tends to maintain the latch arm 80 in a median position as in the previous embodiment. In operation of this embodiment, the keeper assembly 28 engages the latch arm assembly 78, causing the latch pin 50 to move through the keeper assembly 28 in a way identical to that of the previous embodiment.

Referring now to FIGS. 6 and 6*a*, a similar embodiment is illustrated where a spring arm member 90 is formed from a single piece of spring steel so that a mounting flange 92 with a mounting hole 94 is at one end and a latch pin 50 is clinched by a formed loop 96 at the other end. Resilience in the spring arm 98 enables the latch pin 50 to move through the keeper assembly 28 as in the previous embodiments.

The latch device shown in FIGS. 1–4 is provided as a preferred component of the present invention, however there may exist other reciprocating or automatic latch devices of sufficient strength and quality that might also be used.

OPERATION

The manner of retracting the leg rest in the improved reclining chair is identical to that of other spring and/or gravity actuated chairs in present use. Muscular force from the occupant's legs is applied to the legrest in a generally rearward direction until the latch is engaged to retain the chair in an upright and retracted position. The innovation of the present invention lies the manner in which the latch is released. A second, momentary application of force in the same rearward direction is all that is required to release the latch and so enable the chair to move to an extended position.

SUMMARY, RAMIFICATIONS, AND SCOPE

Accordingly, the reader will see that the improved reclining chair of this invention is a true innovation in the art of reclining furniture. The tangible advantages of combining a conventional recliner chair with a reciprocatory latch, will be appreciated in the present invention as providing a chair that:

- is cheaper to build than known chairs;
- eliminates complicated linkage systems presently used in similar chairs;
- will be less prone to failure than known chairs;
- has no exterior control to detract from the chair's appearance;
- is easier to use than existing chairs; and
- does not require the use of the occupant's hands to move it from the upright position to a primary extended position.

A further advantage is that manufacturers can readily benefit by employing the principles of this invention without the need to make expensive changes to existing designs.

In the foregoing description, a reclining chair with three different embodiments of reciprocatory latch are described. As many changes could be made in the above construction and many apparently widely different embodiments of this invention could be made without departing from the scope thereof, it is intended that all matter contained in the above description or shown in the accompanying drawings shall be interpreted as illustrative and not in a limiting sense. Features of the invention believed new and patentable are set forth in the appended claims.

What is claimed is:

1. In a hands-free reclining chair comprising:

a seat, backrest, and a legrest moveable between an extended position forward of said seat and an end-limited rearward position under a front portion of the seat; and a mechanism mounted on said chair and carrying said legrest for providing relative movement between said legrest and said seat under the control of an occupant of the chair, the improvement comprising a reciprocating latch member mounted on said chair for movement between an effective position at which it prevents said relative movement and an ineffective position at which it permits said relative movement, said latch member being disposed for alternating movement between said effective position and said ineffective position by successive deflections of said legrest to said end-limited rearward position under muscular force of said occupant.

2. The chair of claim 1 in which said latch member comprises a first latch means and a second latch means complimentary to the first latch means.

3. The chair of claim 2 in which said first latch means is mounted to the legrest and said second latch means is mounted beneath a center portion of the seat.

4. The chair of claim 2 wherein a cross member is disposed on the mechanism and said first latch means is mounted on the cross member and said second latch means is mounted beneath a center portion of the seat.

5. The chair of claim 1 having two of said latch members.

6. A reclining chair having a seat and a legrest which is movable between an extended and a retracted position, a legrest linkage for moving said legrest between said extended position when the chair is reclined and said retracted position when the chair is upright, drive means on the chair to drive the legrest from its retracted position to said extended position, said drive means disposed for storing energy derived from the retraction of said legrest by actuation of the same in one general direction by an occupant of the chair, and a legrest-operated reciprocating latch means for releasably retaining the legrest in said retracted position, said latch means comprising a first member mounted to and movable with said legrest linkage and a second member to engage the first member and retain the same in said retracted position, said second member being automatically releasable by a second actuation in the same direction.

7. The reclining chair of claim 6 wherein the first member is mounted to the seat.

8. The reclining chair of claim 6 wherein a cross member is disposed beneath the seat and said first member is mounted on the cross member.

9. The reclining chair of claim 6 wherein the second member is connected to the legrest linkage.

10. The reclining chair of claim 9 wherein the first member is connected to the seat.

11. The reclining chair of claim 9 wherein a cross member is disposed beneath the seat and said first member is mounted on the cross member.

* * * * *